US012317985B2

(12) United States Patent
Coutan et al.

(10) Patent No.: US 12,317,985 B2
(45) Date of Patent: Jun. 3, 2025

(54) REFILLABLE STICK CASE

(71) Applicant: PUIG FRANCE, Paris (FR)

(72) Inventors: Frederic Coutan, Paris (FR); Jérôme Liard, Paris (FR)

(73) Assignee: PUIG FRANCE, Paris (FR)

( * ) Notice: Subject to any disclaimer, the term of this patent is extended or adjusted under 35 U.S.C. 154(b) by 0 days.

(21) Appl. No.: 18/550,049

(22) PCT Filed: Mar. 11, 2022

(86) PCT No.: PCT/EP2022/056302

§ 371 (c)(1),
(2) Date: Sep. 11, 2023

(87) PCT Pub. No.: WO2022/189614

PCT Pub. Date: Sep. 15, 2022

(65) Prior Publication Data

US 2024/0148128 A1 May 9, 2024

(30) Foreign Application Priority Data

Mar. 12, 2021 (EP) ..... 21305303

(51) Int. Cl.

*A45D 40/04* (2006.01)
*A45D 40/00* (2006.01)
*A45D 40/20* (2006.01)

(52) U.S. Cl.

CPC ..... *A45D 40/04* (2013.01); *A45D 2040/0031* (2013.01); *A45D 2040/0043* (2013.01); *A45D 2040/0056* (2013.01); *A45D 2040/204* (2013.01)

(58) Field of Classification Search

CPC ..... A45D 40/04; A45D 2040/0043; A45D 2040/0056; A45D 40/00; A45D 2040/204;
(Continued)

(56) References Cited

U.S. PATENT DOCUMENTS

2020/0008559 A1 1/2020 Ohba
2021/0093070 A1* 4/2021 Dinata ..... A45D 40/04
2022/0087399 A1* 3/2022 Dunton ..... A45D 40/16

FOREIGN PATENT DOCUMENTS

EP 3469947 A1 4/2019
FR 3090293 A1 6/2020

OTHER PUBLICATIONS

International Search Report and Written Opinion of International Application No. PCT/EP2022/056302, dated May 20, 2022, 14 pages.

* cited by examiner

*Primary Examiner* — David J Walczak
(74) *Attorney, Agent, or Firm* — Chrisman Gallo Tochtrop LLC

(57) ABSTRACT

A cosmetic applicator device including a refillable stick case and a base for receiving the refillable stick case. The refillable stick case is configured to be removably coupled to the base. The refillable stick case includes a stick holder for holding a stick of a cosmetic material and a tubular guide surrounding the stick holder. The tubular guide extends along a first longitudinal direction between a tubular guide coupling end and a tubular guide open end. The tubular guide includes a main portion having a main portion outer diameter and a coupling portion longitudinally extending from the main portion to the tubular guide coupling end. The base includes an inner member including a guiding protrusion is configured to guide the coupling portion outer surface of the tubular guide during the insertion of the refillable stick case into the base.

19 Claims, 8 Drawing Sheets

(58) Field of Classification Search
CPC ..... A45D 2040/0031; A45D 40/06; A45D 40/205; A45D 2040/208
USPC ..... 401/68, 75, 77, 78, 171, 172
See application file for complete search history.

REFILLABLE STICK CASE

CROSS-REFERENCE TO RELATED APPLICATIONS

This is a National Stage application of PCT international Application PCT/EP2022/056302, filed on Mar. 11, 2022, which claims the benefit of European Patent Application EP21305303.6 filed on Mar. 12, 2021, both of which are incorporated herein by reference in their entirety.

The present disclosure relates to refillable stick cases for a cosmetic applicator device and cosmetic applicator devices comprising a refillable stick case and a base for receiving the refillable stick case.

BACKGROUND

Cosmetic applicator devices are used to apply a cosmetic product or material to a part of the body. A lipstick is an example of a cosmetic applicator device. Lipsticks comprise a cosmetic product or material to provide color, texture and/or protection to the lips. The cosmetic material of the lipsticks may be in the form of a stick or a baton. Other examples of cosmetic applicator device comprising a stick, the stick may be applied to a cheek, to a face or to eyes.

Lipsticks may comprise a base and a lipstick case enclosing a lipstick holder that holds the cosmetic material. The base and the lipstick holder are generally rotatably connected. A rotation of the base with respect to the lipstick case causes an upwards and/or a downwards movement of the cosmetic material. Once the cosmetic material has been consumed, purchasing a new lipstick may be required. A whole new lipstick with a base and a lipstick case is purchased, although some components of the used lipstick may still be usable.

Refillable or replaceable lipsticks may be used for reducing waste of lipstick packaging materials. In these refillable or replaceable lipsticks, several refillable or replaceable lipstick cases may be removable coupled to the base. In this way, once the cosmetic material is consumed, only the refillable lipstick case needs to be purchased. Purchasing a refillable lipstick case may generally be cheaper than purchasing the whole lipstick. Using refillable lipsticks cases may also allow using several cosmetic materials with different colors with a single base.

A refillable lipstick case including a cosmetic material may be removably coupled to a base so as to build a refillable lipstick. Once the cosmetic material of the refillable lipstick is consumed, the refillable lipstick case may be removed from the base and a new refillable lipstick case with a new cosmetic material may be removably coupled to the base.

However, the user may experience problems in coupling a refillable lipstick case to the base. During the insertion of the refillable lipstick case into the base, the user may unintentionally deteriorate the refillable lipstick case and/or the base. For example, the refillable lipstick case may get blocked within the base if the refillable lipstick case is inserted misaligned into the base. The refillable lipstick case may hit a component of the base if the user tries to move the refillable lipstick case with respect to the base for unblocking the refillable lipstick case.

Furthermore, the user may unintentionally insert the refillable lipstick case backwards or in a reverse orientation, i.e. inserting the refillable lipstick case with the cosmetic material facing the base. The cosmetic material of the refillable lipstick may thus be unintentionally contacted by the base. The cosmetic material may thus get damaged and the refillable lipstick case may consequently become unused.

The present disclosure provides examples of devices that at least partially resolve some of the aforementioned disadvantages.

SUMMARY

In a first aspect, cosmetic applicator device is provided. The cosmetic applicator device comprises a refillable stick case and a base for receiving the refillable stick case.

The refillable stick case is configured to be removably coupled to the base. The refillable stick case extends along a first longitudinal direction and the base extends along a second longitudinal direction. The first longitudinal direction is parallel to the second longitudinal direction when the refillable stick is coupled to the base.

The refillable stick case comprises a stick holder for holding a stick of a cosmetic material and a tubular guide surrounding the stick holder. The tubular guide extends along the first longitudinal direction between a tubular guide coupling end and a tubular guide open end. In addition, the tubular guide comprises a main portion having a main portion outer diameter and a coupling portion longitudinally extending from the main portion to the tubular guide coupling end. The coupling portion comprises a coupling portion outer surface defining a coupling portion outer diameter, wherein the main portion outer diameter is greater than the coupling portion outer diameter at the tubular guide coupling end. Furthermore, the stick holder is configured to be moved inside the tubular guide in the first longitudinal direction.

The base comprises an inner member having a transverse wall extending in a direction perpendicular to the second longitudinal direction. The inner member comprises a guiding protrusion. The guiding protrusion protrudes from a protrusion proximal end at the transverse wall to a protrusion distal end in a direction substantially parallel to the second longitudinal direction. The guiding protrusion is further configured to guide the coupling portion outer surface of the tubular guide during the insertion of the refillable stick case into the base.

In this disclosure, a refillable stick shall be understood as a stick comprising a base and a stick case enclosing a cosmetic material coupled to the base so as to use different cosmetic materials in the base. The cosmetic material may be applied e.g. to the lips, face, cheek or to the eyes. A refillable stick adapted to hold a cosmetic material to be applied to the lips may be called refillable lipstick. Accordingly, a refillable lipstick is an example of refillable stick.

In this disclosure, a refillable stick case shall be understood as the component of a refillable stick configured to be coupled to a base to form a refillable stick.

The guiding protrusion of the inner member of the base and the coupling portion of the tubular guide allows efficiently guiding the refillable stick case during its insertion into the base. As the main portion outer diameter is greater than the coupling portion outer diameter at the tubular guide coupling end, the refillable stick guidance of the refillable stick case may be enhanced. The refillable stick case may thus be easily inserted into the base. Risks of unintentionally damaging the components of the cosmetic applicator device may consequently be reduced.

Furthermore, as the main portion outer diameter is greater than the coupling portion outer diameter, the guiding protrusion may prevent the refillable stick case from being inserted backwards, e.g. firstly inserting the main portion than the coupling portion of the tubular guide. The guiding protrusion may stop the insertion of the refillable stick case by contacting the main portion of the tubular guide. The specific shape of the tubular guide and the inner member constitutes a mistake-proofing system. A mistake-proofing system is a system that prevents an incorrect operation by the user. In this case, the cosmetic applicator device prevents an incorrect insertion of the refillable stick case. This may prevent the cosmetic material from being unintentionally contacted by a part of the base. Risk of damaging the cosmetic material may thus be reduced.

In some examples, the coupling portion of the tubular guide comprises a tapered region. The coupling portion outer diameter decreases towards the tubular guide coupling end. A smooth guidance of the refillable stick case may thus be improved. The tubular guide may comprise a main portion with a substantially constant main portion outer diameter and a tapered region arranged at the tubular guide coupling end. The frustoconical or tapered region may extend from the main portion towards the tubular guide coupling end, e.g. the end of the tubular guide facing the inner member of the base. At the tapered region, the coupling portion outer diameter gradually decreases from a first diameter to a second diameter, wherein the first diameter is greater than the second diameter. Accordingly, the coupling portion outer diameter progressively decreases at the tapered region towards the tubular guide coupling end. The coupling portion outer surface may be substantially smooth. Frictional forces against the guiding protrusion may thus be reduced.

In some examples, the coupling portion outer diameter at the tapered region continuously decreases from the main portion outer diameter to the coupling portion outer diameter at the tubular guide coupling end. Alternatively, the coupling portion of the tubular guide comprises a lower straight region, wherein the tapered region is between the main portion and the lower straight region.

The guiding protrusion may comprise a shape complementary to the coupling portion, e.g. complementary to the tapered region of the tubular guide. The coupling portion may thus easily engage the guiding protrusion. The refillable stick case may thus be easily guided during the insertion. In addition, this complementary shape may help to maintain the tubular guide in a required position when the tubular guide is connected to the inner member. In these examples, as the guiding protrusion comprises a shape complementary to the coupling portion, the guiding protrusion comprises a tapered region. For example, the guiding protrusion may comprise a straight portion and a tapered portion.

In some examples, the guiding protrusion comprises a wedge-shaped cross-section to substantially engage the tapered region of the coupling region of the tubular guide. An inner surface of this wedge-shaped cross-section may face the coupling portion outer surface at the tapered portion. The guiding protrusion may thus comprise a tapered portion extending from the protrusion proximal end to a protrusion distal end.

In some examples, the guiding protrusion is annular. Alternatively, the guiding protrusion may comprise a plurality of annular segments. A gap may be defined between two consecutive annular segments. In these examples, the inner surface of these annular segments is configured to engage the outer tube. The shape of these annular segments is thus complementary to the guiding portion. For example, the annular segments may comprise a wedge-shaped cross-section.

The annular segments may extend a predetermined angle of a circumference. Manufacturing processes become easier with annular segments instead of a annular guiding protrusion (extending 360°), since injection or moulding processes may be improved, while guiding of the tubular guide is maintained. In some examples, the annular segments may extend between 0.5°-45° of a circumference. In some examples, the annular segments extend between 0.5°-5° of a circumference. The guiding protrusion may comprise a plurality of annular segments, e.g. between 3 and 10, specifically between 3 and 8.

In an example, the guiding protrusion comprises four annular segments, each of them extending about 2° of a circumference. In this example, a gap of 88° of a circumference is defined between two consecutive annular segments.

The guiding protrusion may comprise a guiding protrusion inner diameter. The guiding protrusion inner diameter may be defined by the inner surface of the wedge-shaped cross-section. The inner surface of the wedge-shaped cross-section may be inclined with respect to the second longitudinal direction. In this way, the guiding protrusion inner diameter increases from the transverse wall. The guiding protrusion inner diameter at the protrusion proximal end may be greater than the guiding protrusion inner diameter at the protrusion distal end. The inner surface of the wedge-shaped cross-section may thus substantially fit the tapered region of the tubular guide.

In some examples, the coupling portion outer surface at the tapered portion of the tubular guide forms an angle between 1° and 10° with the first longitudinal direction. In some examples, this angle may be between 4° and 8°. These angles may improve the manufacturing process. For example, for a tubular guide made from plastic, these angles allow an easy extraction from an injection tool.

In some of these examples, the inner surface of the guiding protrusion may form an angle between 1° and 10° with the second longitudinal direction. In some examples, this angle may be between 4° and 8°. In this way, the inner surface of the guiding protrusion mates the coupling portion outer surface. The inner surface of the guiding protrusion may thus be substantially parallel to the coupling outer surface at the tapered region.

In some examples, the main portion outer diameter of the tubular guide is 0.5-1.5 millimetres greater than the coupling portion outer diameter at the tubular guide coupling end. This diameter difference may allow the guiding protrusion to easily guiding the tubular guide towards the inner member. In addition, this diameter difference between the main portion outer diameter and the coupling portion outer diameter at the tubular guide coupling end may improve the retention of the tubular tube into the inner member. In further examples, the main portion outer diameter of the tubular guide is about 0.9 millimetres greater than the coupling portion outer diameter at the tubular guide coupling end.

In some examples, the refillable stick case comprises a tubular shell surrounding the tubular guide. The tubular shell extends from a tubular shell first end to a tubular shell second end. The tubular shell may extend a tubular shell height between the tubular shell first end and the tubular shell second end. The tubular guide extends a tubular guide height between the coupling end and the open end. The tubular shell height may be greater than the tubular guide height. The tubular shell height may be between 3 and 5 millimetres, for example about 4 millimetres, greater than the tubular guide height.

In some examples, the tubular shell first end and the coupling end of the tubular guide are substantially in the same plane. The coupling end of the tubular guide may thus be surrounded or covered by the tubular shell first end. The coupling end of the tubular guide may thus be protected by the tubular shell.

In some examples, a cavity is formed between the tubular shell at the at the tubular shell first end and the coupling portion. The tubular shell may comprise a tubular shell inner surface defining a tubular shell inner diameter. The tubular shell inner diameter may be substantially constant along the tubular shell height. In some examples, for example, when the coupling portion comprises a tapered portion, the cavity is annular and comprises a substantially wedge-shaped cross-section.

The guiding protrusion may be received by the cavity formed between the tubular shell and the tubular guide. The guiding protrusion may thus be enclosed between the coupling portion outer surface and the tubular shell outer surface. The refillable stick case may thus be precisely guided towards the base. In addition, fixation of the refillable stick case into the base may be improved. Consequently, the stick of a cosmetic material held by the stick holder may be precisely moved inside the tubular guide.

In some examples, the coupling portion of the tubular guide comprises a coupling bracket and the inner member comprises a connector configured to be removably coupled to the coupling bracket of the tubular guide. The refillable stick case may thus be removably coupled to the base through the connection between the coupling bracket and the connector.

In some examples, the tubular shell comprises a rim at the tubular shell second end. The rim extends inwards in a radial direction form the tubular shell inner surface. The rim may cover at least a portion of the tubular guide open end. The rim thus extends from the tubular shell inner surface towards the tubular guide in a radial direction. The radial direction is substantially perpendicular to the first longitudinal direction. In some examples, a tubular guide wall defined between the inner surface tubular guide and the outer surface tubular guide may be covered by the rim. The rim may thus protect the tubular guide.

If the refillable stick case is intended to be inserted into the base in a reverse orientation, i.e. the tubular guide open end facing the face, the guiding protrusion contacts the rim to prevent a full insertion. The guiding protrusion may thus be configured to contact the rim of the tubular shell during the insertion of the refillable stick into the base when the tubular guide open end faces the base. The insertion of the refillable stick case in a reverse orientation may thus be stopped by the guiding protrusion. This may prevent the stick of cosmetic material from being unintentionally contacted by the inner member, e.g. by the connector of the inner member. Risk of damaging the stick cosmetic material may thus be reduced.

In a further aspect, a refillable stick case for a cosmetic applicator device is provided. The refillable stick case may be according to any of the examples herein disclosed. The refillable stick case is configured to be removably coupled to a base of a cosmetic applicator device. The refillable stick case and a base may thus form a cosmetic applicator device according to any of the examples herein disclosed, e.g. a refillable stick. In some examples, the refillable stick case may be a refillable lipstick case.

The refillable stick case extends along a first longitudinal direction and comprises a stick holder for holding a stick of a cosmetic material and a tubular guide surrounding the stick holder. The tubular guide extends along the first longitudinal direction between a tubular guide coupling end and a tubular guide open end. The stick holder is configured to move inside the tubular guide in the first longitudinal direction.

Furthermore, the tubular guide comprises a main portion having a main portion outer diameter and a coupling portion longitudinally extending from the main portion to the tubular guide coupling end. The coupling portion may comprise a tapered portion comprising a coupling portion outer surface defining a coupling portion outer diameter. The coupling portion outer diameter of this example decreases towards the tubular guide coupling end so that the main portion outer diameter is greater than the coupling portion outer diameter at the tubular guide coupling end.

Advantages derived from this second aspect may be similar to those mentioned regarding the cosmetic applicator device of the first aspect. Namely, refillable stick case may be easily guided during insertion into the base. Furthermore, a wrong insertion is prevented, e.g. when the refillable stick case is intended to be inserted in the reverse orientation.

In yet a further aspect, a kit comprising a base and a plurality of refillable stick cases configured to be removable to the base is provided. Therefore, the user may removable couple one of the refillable stick case to the base to apply a specific stick of cosmetic material. For example, each refillable stick case may comprise a stick with a different colour. The user may thus apply different colours using a single base. The base of this kit may be according to any of the examples herein disclosed. The plurality of refillable stick cases may be according to any of the examples herein disclosed.

BRIEF DESCRIPTION OF THE DRAWINGS

Non-limiting examples of the present disclosure will be described in the following, with reference to the appended drawings, in which.

DETAILED DESCRIPTION OF EXAMPLES

In these figures the same reference signs have been used to designate matching elements.

Figure 1:
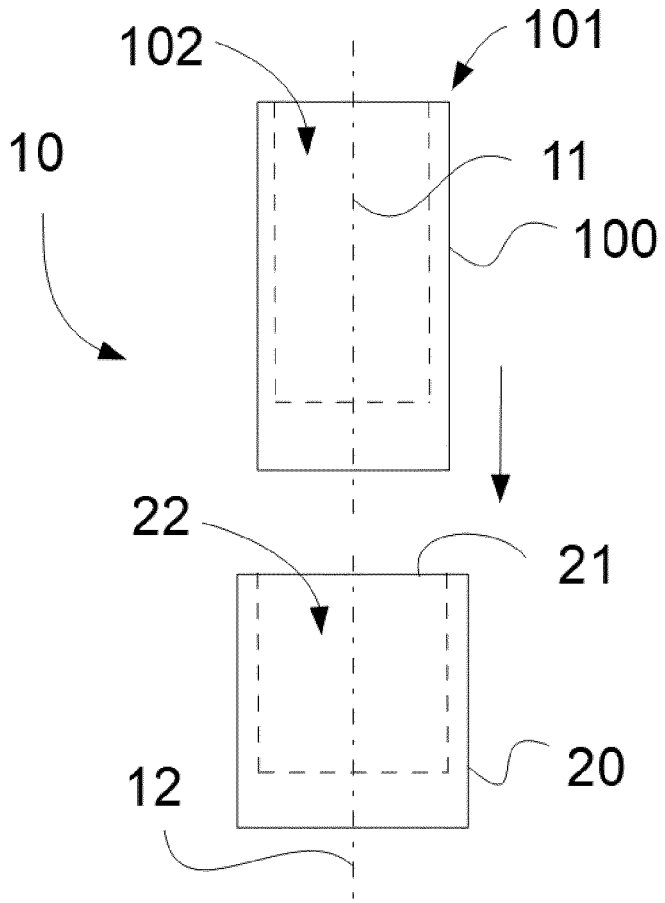
FIG. 1 shows an example of a cosmetic applicator device according to the present disclosure.

FIG. 1 shows an example of a cosmetic applicator device 10 comprising a refillable stick case 100 and a base 20. The refillable stick case 100 can be inserted and removably coupled to the base 20. The base 20 comprises an open end 21 and a cavity 22 for receiving the refillable stick case 100. The refillable stick case 100 comprises a cavity 102 to accommodate a stick of cosmetic material (not shown in this figure) and an open end 101 to allow a portion of the stick of cosmetic material to emerge from inside the refillable stick case. A user may couple the refillable stick case 100 to the base 20. Then, the user may move the stick of a cosmetic material of the refillable stick case along the cavity 102 to apply this cosmetic material to the lips.

The refillable stick case 100 extends along a first longitudinal direction 11 and the base extends along a second longitudinal direction 12. When the refillable stick case 100 is coupled to the base 20 the first longitudinal direction 11 is parallel to the second longitudinal direction 12.

Figure 2A:
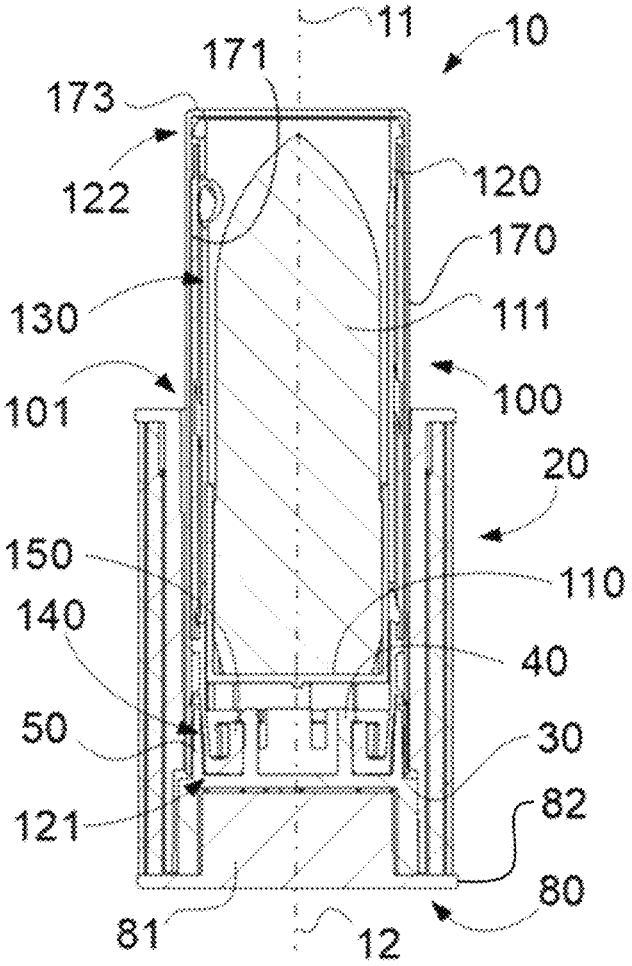
FIG. 2*a* shows a cross-sectional view of a cosmetic applicator device according to one example of the present disclosure.
Figure 2B:
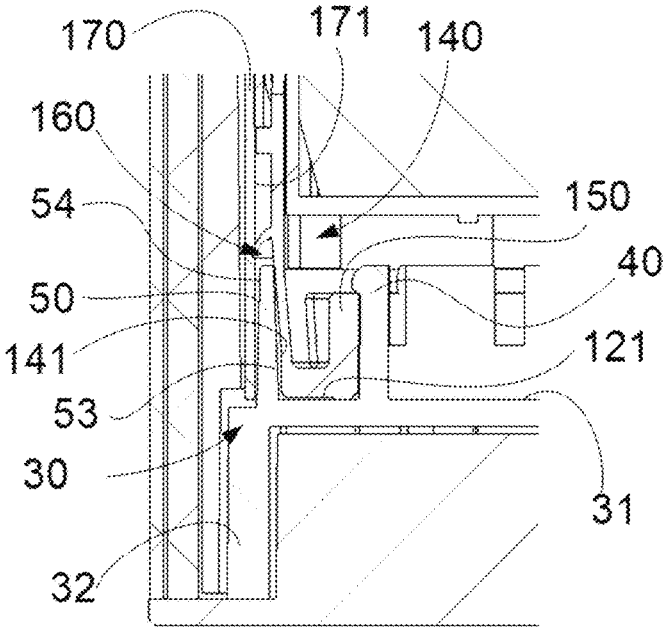
FIG. 2*b* is a zoom-in view of the connection of the refillable stick case to the base of the cosmetic applicator device according to FIG. 2*a;*

FIG. 2*a* shows a cross-sectional view of a cosmetic applicator device 10 having a refillable stick case 100 and a base 20. FIG. 2*b* is a zoom-in view of the connection of refillable stick case 100 to the base 20. The refillable stick case 100 is removably coupled to the base 20.

The refillable stick case 100 comprises a stick holder 110 for holding a stick 111 of a cosmetic material. The stick of a cosmetic material of this example is a lipstick, i.e. is configured to be applied to the lips. The stick holder 110 can be moved inside the tubular guide 120 for extracting a portion of the stick of a cosmetic material from the refillable stick case 100. The tubular guide 120 extends along the first longitudinal direction 11 between a tubular guide coupling portion 140 and a tubular guide open end 122.

The tubular guide 120 comprises a main portion 130 and a coupling portion 140. In FIG. 2*a*, the main portion 130 corresponds to the upper portion and the coupling portion 140 to the lower portion of the tubular guide. The main portion 130 extends from the tubular guide open end 122 to the coupling portion 140. The coupling portion 140 extends from the main portion 130 to the tubular guide coupling end 121.

The coupling portion 140 comprises a coupling bracket 150 and a coupling portion outer surface 141 defining a coupling portion outer diameter. The main portion outer diameter is greater than the coupling portion outer diameter.

In this example, the coupling portion 140 comprises a tapered region 160 reducing the coupling portion outer diameter towards the tubular guide coupling end 121. The coupling portion outer surface 141 of these figures forms an angle between 1° and 10° with the first longitudinal direction 11.

The base 20 comprises an inner member 30 having a transverse wall 31 extending in a direction perpendicular to the second longitudinal direction 12. In this example, the inner member 30 comprises a connector 40 and a guiding protrusion 50. In these figures the connector 40 is coupled to the coupling bracket 150 of the tubular guide 120.

The guiding protrusion 50 extends from a protrusion proximal end at the transverse wall 31 to a protrusion distal end in a direction substantially parallel to the second longitudinal direction 12. As in these figures the refillable stick case 100 is coupled to the base 20, a guiding protrusion inner surface 53 engages the coupling portion outer surface 141.

The guiding protrusion 50 of these figures comprises a substantially wedge-shaped cross-section. In these figures, the guiding protrusion 50 has an annular shape. The wedge-shaped cross-section thus extends along a whole circumference. In other examples, a plurality of annular segments may comprise a substantially wedge-shaped cross-section. The guiding protrusion inner surface 53 defines a guiding protrusion inner diameter. In these figures, this guiding protrusion inner diameter increases from the transverse wall 31 to the open end 21 of the base 20.

The shape of the guiding protrusion inner surface 53 of these figures is complementary to the shape of the coupling portion outer surface 141. The guiding protrusion inner surface 53 of this example substantially fits the coupling portion outer surface 141.

The inner member 30 of these figures comprises a shape of an inverted cap having a lateral wall 32 extending from the transverse wall 31 in a direction parallel to the second longitudinal direction. The lateral wall 32 is substantially perpendicular to the transverse wall 31. The lateral wall 32 defines an inner cavity.

In this example, the base 20 further comprises a support element 80 that engages the inner member. The support element 80 comprises a cylindrical body 81 inserted in the inner cavity defined by the lateral wall 32 of the inner member 30. In this example, the support element 80 further comprises a flange 82 extending outwardly from the cylindrical body 81 in a radial direction. The flange 82 may support the lateral wall 32 of the inner member 30.

In some examples, the inner member 30 comprises a plurality of abutments to engage a sleeve arranged surrounding this inner member 30. The abutments may be arranged at the lateral wall 32. The plurality of abutments may form an annular gear. The abutments may be distributed along the outer perimeter of the lateral wall 32 and may extend outwardly from an outer surface of the lateral wall 32. The sleeve may comprise a plurality of abutments engaging the abutments of the inner member 30. The rotation of the sleeve may cause the rotation of the inner member 30. When the refillable stick case 100 is coupled to the base 20, e.g. when the coupling bracket 150 of the tubular guide 120 is coupled to the connector 40 of the inner member 30, a rotation of the inner member 30 causes a rotation of the tubular guide 120. The rotation of the tubular guide 120 causes a movement of the stick holder 110 in the first longitudinal direction 11.

In this example, the refillable stick case 100 comprises a tubular shell 170 surrounding the tubular guide 120. The tubular shell 170 extends from a tubular shell first end to a tubular shell second end. The tubular shell first end is close to the tubular guide coupling end 121 and the tubular shell second end is close to the tubular guide open end 122. In these figures, the tubular shell 170 covers the tapered region 160 of the coupling portion 140. Protection of the coupling portion may thus be enhanced.

As can be seen in these figures, the guiding protrusion 50 is enclosed between the coupling portion outer surface 141 and a tubular shell inner surface 171. When the tubular guide is coupled to the inner member, as in these figures, the coupling portion outer surface 141 may contact the guiding protrusion inner surface 53. However, a gap is defined between the tubular shell inner surface 171 and the guiding protrusion outer surface 54. This gap allows the inner member 30 and the tubular guide 120 to rotate relative to the tubular shell.

The tubular shell 170 of FIG. 2*a* comprises a rim 173 arranged at the tubular shell second end. In this example, the rim 173 extends inwardly from the tubular shell inner surface 171 in a radial direction, i.e. perpendicular to the first longitudinal direction 11. The rim 173 of this figure covers at least a portion of the tubular guide open end 122. The rim 173 may define the outermost surface of the refillable stick case of FIG. 2*a*.

In this example, the tubular guide 120 and the inner member 30 is made from plastics. Manufacturing costs of the cosmetic applicator may be reduced. The tubular shell may be made from aluminium. Resistance and aesthetics of the refillable stick case may thus be increased. The base may comprise an external cover. This cover may be made from aluminium to increase the overall resistance of the cosmetic applicator device and for aesthetic reasons.

Figure 3A:
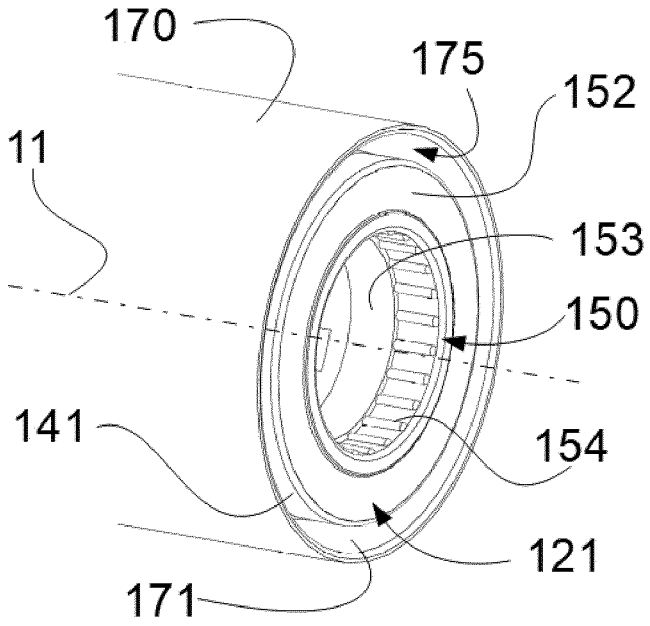
FIG. 3*a* shows an isometric view of a coupling portion of a tubular guide of a refillable stick case according to an example of the present disclosure.
Figure 3B:
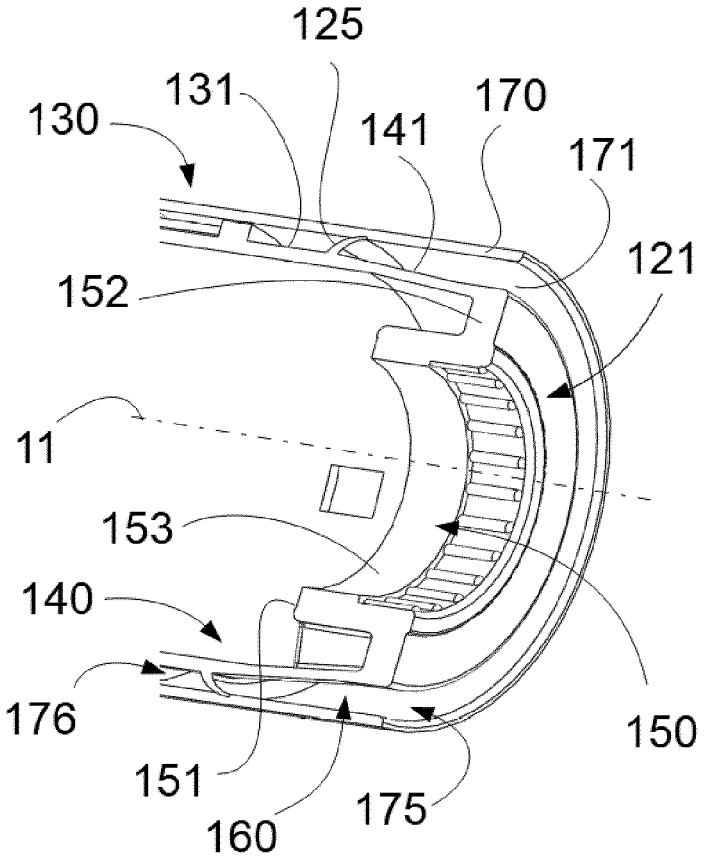
FIG. 3*b* is a cross-sectional view of the coupling portion of the tubular guide of FIG. 3*a;*

FIG. 3*a* shows an isometric view of a coupling portion 140 of a tubular guide of a refillable stick case according to an example of the present disclosure. FIG. 3*b* is a cross-sectional view of the coupling portion 140 of the tubular guide of FIG. 3*a*.

The coupling portion 140 of these figures comprises a tapered region 160 surrounded by a tubular shell 170. The tapered region 160 comprises a coupling portion outer surface 141 facing the tubular shell inner surface 171. An annular cavity 175 is formed between the tubular shell 170 and the tapered region 160. The annular cavity 175 is defined between the coupling portion outer surface 141 and the tubular shell inner surface 171. A guiding protrusion of the base may be received in the cavity 175.

The tubular guide 120 of these figures comprises an annular lip 125 extending outwardly from the tubular guide outer surface. The annular lip 125 may be flexible to adjust the position of the tubular shell 170 relative to the tubular guide 120. In some examples, a distal end of the annular lip contacts the tubular shell inner surface 171. The annular lip 125 may thus close a side of the cavity 175. The annular cavity may thus be defined between the coupling portion outer surface 141, the annular lip 125 and the tubular shell inner surface 171. The annular lip may help to precisely adjust the relative position between the guiding protrusion of the inner member and the coupling portion 140 of the tubular guide.

In these figures, the annular lip 125 extends from a transition region between the main portion outer surface 131 and the coupling portion outer surface 141. The annular lip 125 may thus separate the annular cavity 175 and a gap 176 defined between the main portion outer surface 131 and the tubular shell inner surface 171. A spiral tube (not shown in these figures) may be arranged in the gap 176.

In these figures, the coupling portion comprises a coupling bracket 150. The coupling bracket 150 comprises a coupling tube 151 extending a coupling tube heigh from the tubular guide coupling end 121 towards the tubular guide open end in a direction parallel to the first longitudinal direction 11. The coupling bracket 150 further comprises a wall 152 extending radially form the coupling portion outer surface 141 to the coupling tube 151. The wall 152 of these figures is substantially perpendicular to the first longitudinal direction 11. The wall 152 covers the internal cavity of the tubular guide. The coupling tube 151 is used to be removably coupled to the connector of the inner member of the base. For example, a plurality of snap-fit elements of a connector of the base may engage the coupling tube 151 to secure the refillable stick case to the base.

The coupling tube 151 of these figures comprises a coupling tube inner surface 153 to face a connector outer surface of the base. In this example, the coupling tube inner surface 153 comprises a plurality of bumps 154. When the refillable stick case is coupled to the base, the connector of the base may be surrounded by the coupling tube 151. The plurality of bumps 154 engage the connector of the base so as to prevent an undesirable rotation of the coupling tube of the refillable stick case about the inner member of the base.

Figure 4A:
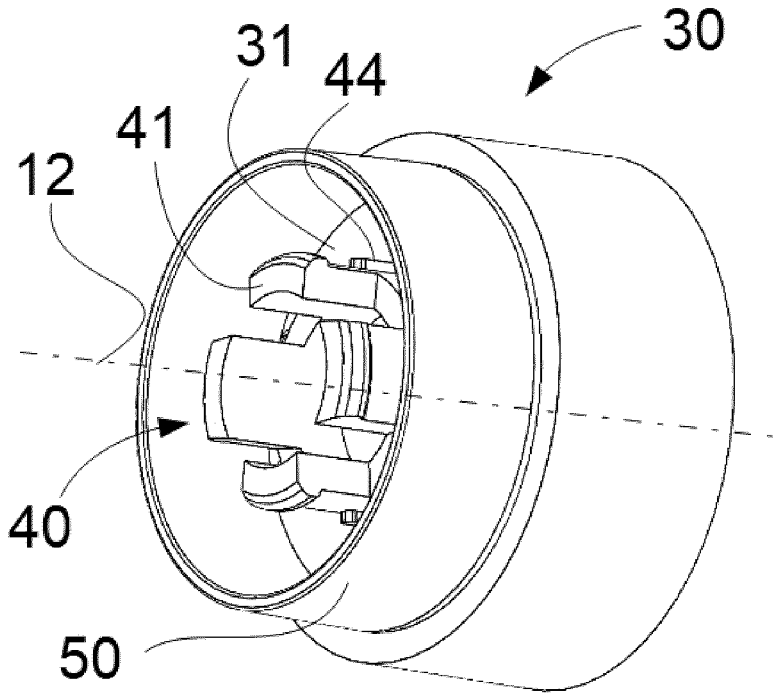
FIG. 4*a* shows an isometric view of an inner member of a base according to an example of the present disclosure.
Figure 4B:
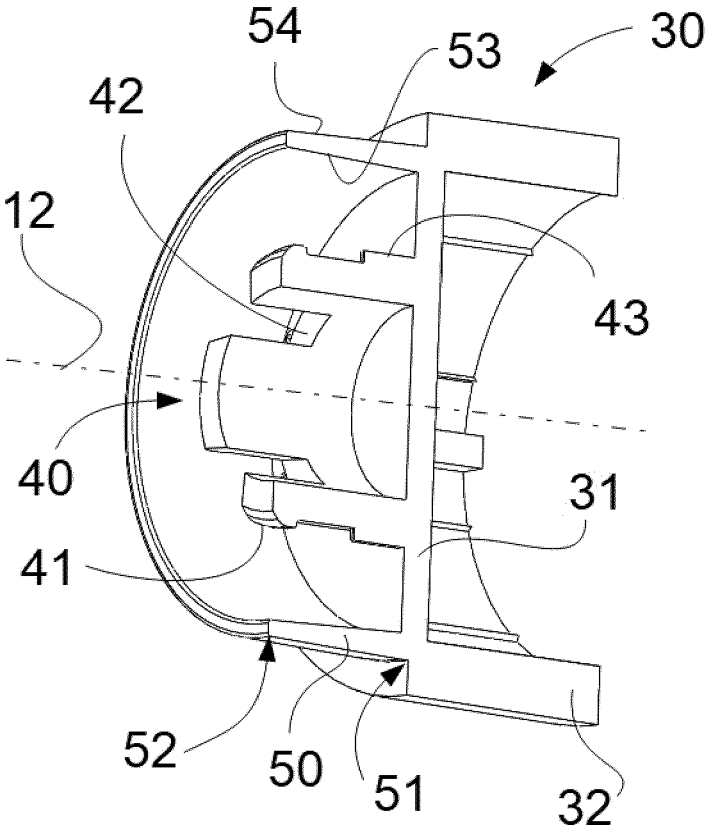
FIG. 4*b* is a cross-sectional view of the inner member of the base of FIG. 4*a;*

FIG. 4*a* shows an isometric view of an inner member 30 of a base according to an example of the present disclosure. FIG. 4*b* is a cross-sectional view of inner member 30 of FIG. 4*a*. The inner member 30 of these figures is configured to be coupled to a tubular guide having a coupling portion according to the example of FIGS. 3*a* and 3*b*.

The inner member 30 of these figures comprises an inverted cap shape having a lateral wall 32 extending from a transverse wall 31. The guiding protrusion 50 protrudes from the transverse wall 31 in a direction parallel to the second longitudinal direction 12. The inner member 30 of these figures comprises a connector 40 configured to engage the coupling bracket of the tubular guide. The connector 40 also protrudes from the transverse wall 31 in a direction parallel to the second longitudinal direction 12.

In this example, the connector 40 extends a connector height from the transverse wall 31 in a direction parallel to the second direction. The guiding protrusion 50 further protrudes a protrusion height from the transverse wall 31 in a direction parallel to the second direction. In this example, the protrusion height and the connector height are substantially similar. As will be discussed in more detail later, these heights reduce the risk of damaging a stick of cosmetic material if the refillable stick is inserted backwards or in a reverse orientation. In further examples, the protrusion height may be greater than the connector height.

As explained with respect to FIGS. 2*a* and 2*b*, the guiding protrusion extends from a protrusion proximal end 51 at the transverse wall 31 to a protrusion distal end 52. The coupling portion of the tubular guide of a refillable stick case may be arranged between the guiding protrusion inner surface 53 and the connector 40. The guiding protrusion outer surface 54 may face a tubular shell when the refillable stick case is inserted into the base. The guiding protrusion of these figures is annular and comprises a wedge-shaped cross-section. However, in other examples, the guiding protrusion may comprise a plurality of annular segments. These annular segments may comprise a wedge-shaped cross-section.

In these figures, the connector 40 of the inner member comprises a plurality of snap-fit elements 41 to engage a coupling tube of a coupling bracket of a refillable stick case. The snap-fit elements 41 temporary connects the coupling tube (and consequently the coupling tube inner surface) to the inner member. In this example, the plurality of snap-fit elements 41 is orientated outwards. Alternatively, the plurality of snap-fit elements may be orientated inwards to surround the coupling tube.

In these figures, a ring 42 joins the plurality of snap-fit elements 41. The ring 42 comprises a ring outer surface 43 to engage a coupling tube inner surface. The ring outer surface 43 comprises a protuberance 44. This protuberance may be fit between two consecutive bumps of the coupling tube inner surface. Rotation of the tubular guide about the inner member may thus be prevented.

Figure 5:
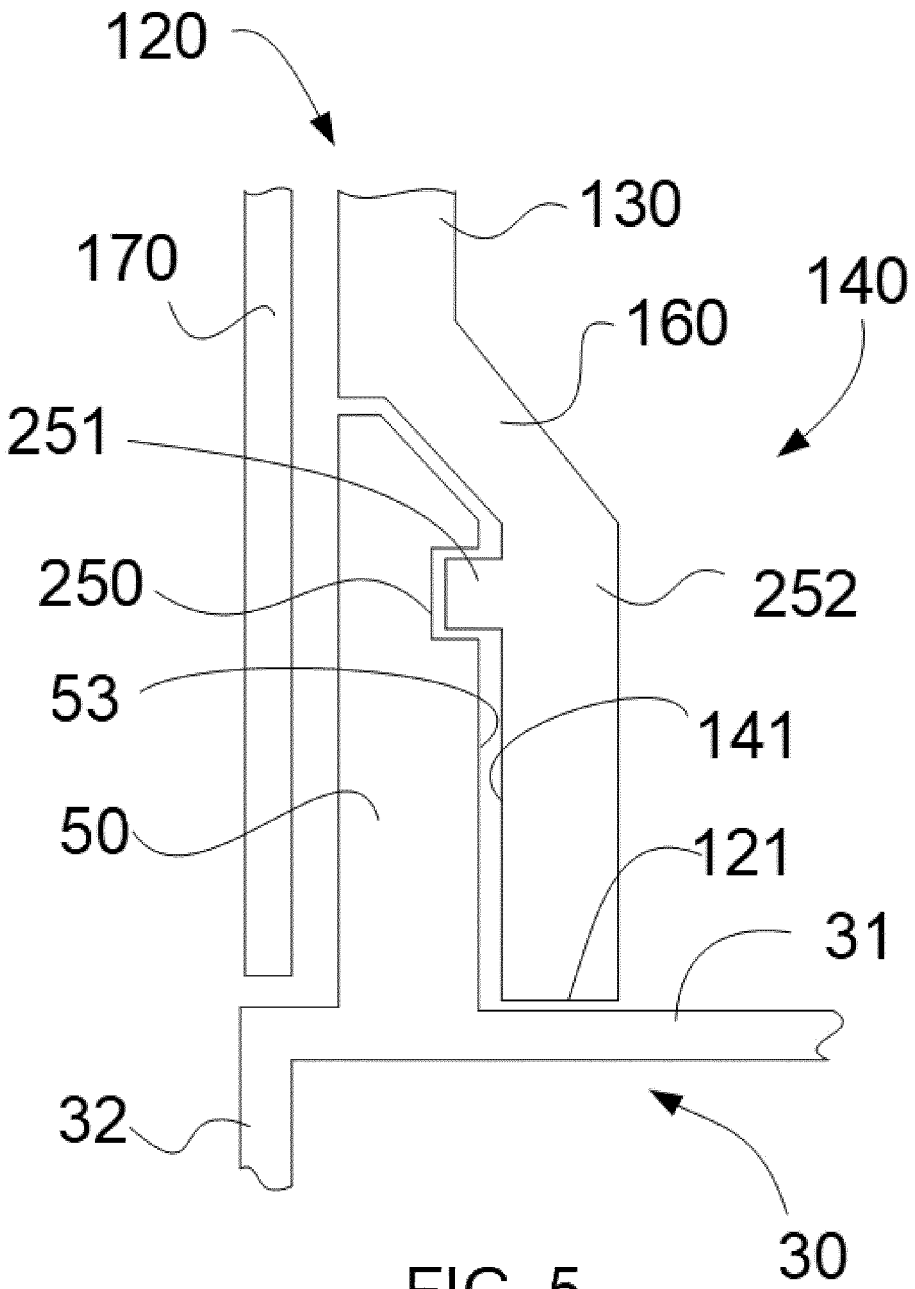
FIG. 5 schematically illustrates a connection of the refillable stick case to the base of the of the cosmetic applicator according to an example of the present disclosure.

FIG. 5 schematically illustrates a connection of the refillable stick case to the base of the of the cosmetic applicator according to an example of the present disclosure. The tubular guide 120 comprises a coupling portion 140 and a main portion 130. A tubular shell 170 surrounds the tubular guide 120. The coupling portion 140 comprises a tapered region 160. In addition, the coupling portion 140 of this figure comprises a lower straight region 252.

In this figure, the tapered region 160 extends from the main portion 130 to the lower straight region 252. The lower straight region 252 extends from the tapered region 160 to the tubular guide coupling end 121. The coupling portion outer surface 141 defines a coupling portion outer diameter that decreases at the tapered region 160. The coupling portion outer diameter is substantially constant at the lower straight region 252.

The inner member 30 of this figure comprises a guiding protrusion 50 protruding from a transverse wall 31. In this example, the inner member comprises an inverted cap shape having a lateral wall 32 extending from the transverse wall 31.

The coupling portion outer surface 141 of the tubular guide 120 comprises a plurality of protrusions 251 configured to engage a plurality of receivers 250 of the guiding protrusion. The plurality of protrusions 251 of this figure is arranged at the lower straight region 252. The protrusions 251 of the tubular guide fit the receivers of the inner base. A connection between the tubular guide and the inner base may thus be established.

In this figure, the coupling portion 140 does not comprise a coupling bracket, for example the coupling bracket depicted in FIGS. 3*a*-3*b*. However, in other examples, the coupling portion 140 comprises a coupling bracket and the plurality of protrusions 251. In this figure, the inner member 30 does not comprise a connector, for example the connector depicted in FIGS. 4*a*-4*b*. However, in other examples, the inner member 30 comprises a connector and the plurality of receivers 250.

In some examples, the plurality of protrusions may be arranged at the guiding protrusion inner surface and the coupling portion outer surface may comprise a plurality of receivers to receive the protrusions.

Figure 6:
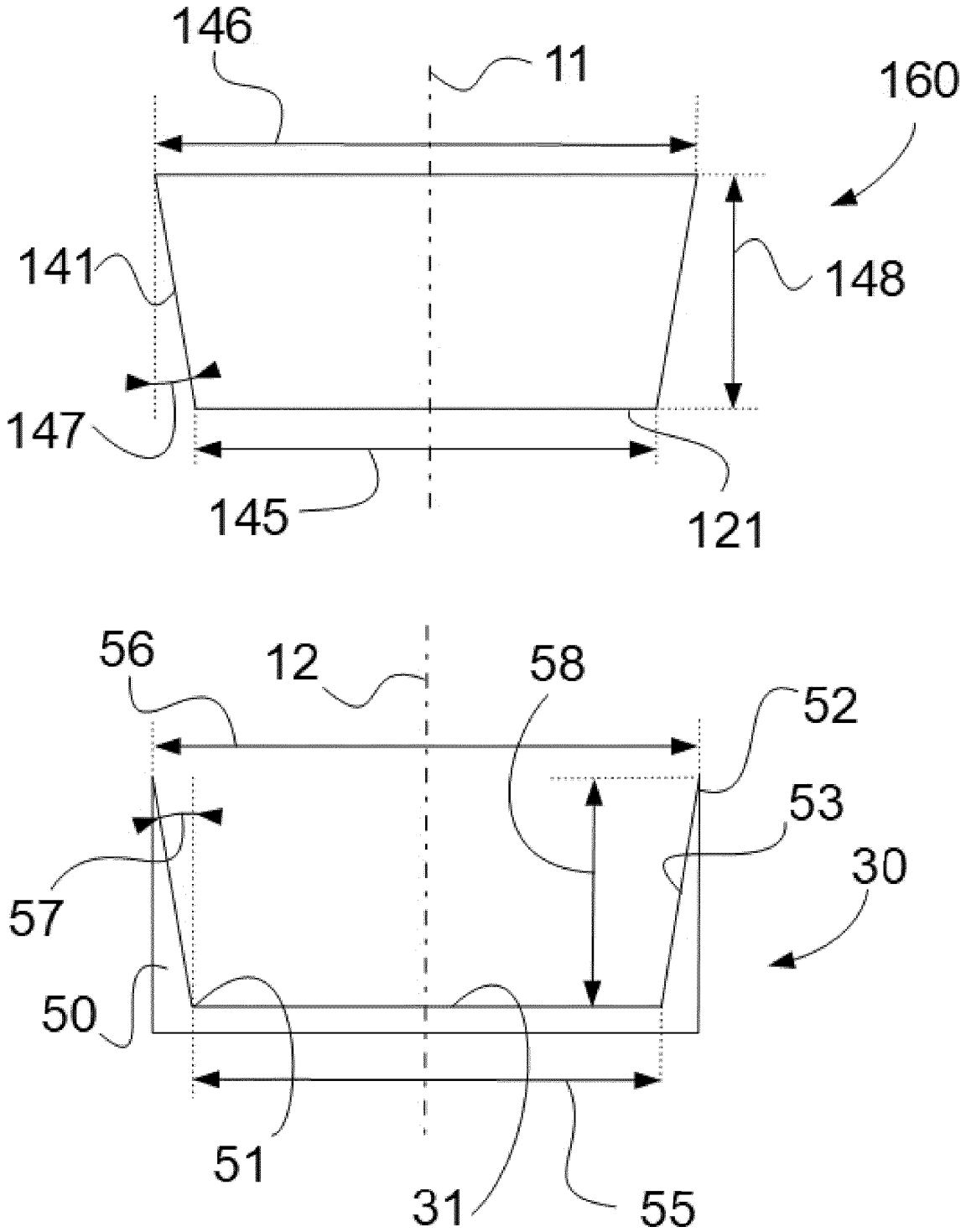
FIG. 6 schematically represents a tapered region of a tubular guide and a guiding protrusion of an inner member according to an example of the present disclosure.

FIG. 6 schematically represents a tapered region 160 of a coupling portion of a tubular guide and a guiding protrusion 50 of an inner member 30 according to an example of the present disclosure. In some examples, the coupling portion may also comprise a coupling bracket and the inner member may also comprise a connector.

The tapered region 160 comprises a coupling portion outer surface 141 which defines a coupling portion outer diameter. This coupling portion outer diameter of the tapered region 160 decreases towards the tubular guide coupling end 121. In this figure, a main portion outer diameter is represented by 146 and the coupling portion outer diameter at the tubular guide coupling end 121 is represented by 145.

In this figure, the main portion outer diameter 146 is about 14.8 millimetres. The coupling portion outer diameter 145 of this figure is about 13.9 millimetres. In this figure, the difference between the coupling portion outer diameter 145 at the tubular guide coupling end 121 and the main portion outer diameter 146 is about 0.9 millimetres.

In some examples, the coupling portion outer diameter 145 may be between 13.5 millimetres and 14.3, optionally between 13.8 millimetres and 14.0 millimetres. The main portion outer diameter 146 may be between 14.4 millimetres and 15.2 millimetres, optionally between 14.7 and 14.9 millimetres. In these examples, the main portion outer diameter 146 is 0.5-1.5 millimetres greater than the coupling portion outer diameter 145 at the tubular guide coupling end 121, optionally about 0.9 millimetres.

The tapered region 160 of the tubular guide of this figure fits the cavity defined by the guiding protrusion inner surface 53 of the guiding protrusion 50 of the inner member 30. The guiding protrusion 50 of this figure extends from the guiding protrusion proximal end 51 at the transverse wall 31 to the guiding protrusion distal end 52. In this figure, the guiding protrusion inner surface 53 defines a guiding protrusion inner diameter that decreases towards the transverse wall 31. The guiding protrusion inner diameter of this example substantially corresponds to the coupling portion outer diameter.

The guiding protrusion inner diameter at the protrusion distal end 52 is represented by 56 and the guiding protrusion inner diameter at the protrusion proximal end 51 is represented by 55. In this figure, the guiding protrusion inner diameter 55 is about 14.0 millimetres and the guiding protrusion inner diameter 56 is about 14.9 millimetres.

In some examples, the guiding protrusion inner diameter 55 may be between 13.6 and 14.4 millimetres, optionally between 13.9 and 14.1 millimetres. The guiding protrusion inner diameter 56 may be between 14.5 and 15.3 millimetres, optionally between 14.8 and 15.0 millimetres.

The guiding protrusion inner diameter 55 of this figure is equal or greater than the coupling portion outer diameter 145. The tubular guide may thus be fitted and retained into the inner base.

In this figure, the tapered region 160 extends a tapered height 148 parallel to the first longitudinal direction 11. The tapered height 148 of this figure is about 6 millimetres. In this example, the tapered height 148 extends from the tubular guide main portion to the tubular guide coupling end 121. In some examples, the tapered height 148 may be between 4 and 8 millimetres, optionally between 5 and 7 millimetres, e.g. about 6 millimetres.

The guiding protrusion 50 of this figure extends a guiding protrusion height 58 between the guiding protrusion proximal end 51 at the transverse wall 31 and the guiding protrusion distal end 52. The guiding protrusion height 58 is similar to the tapered height 148. The guiding protrusion height 58 may be between 4 and 8 millimetres, optionally between 5 and 7 millimetres. In this figure, the guiding protrusion height 58 is about 6 millimetres.

The coupling portion outer surface 141 forms an angle 147 with the first longitudinal direction 11. The angle 147 may be between 1° and 10°, optionally between 4° and 8°. In this example, the angle 147 is about 7°.

The guiding protrusion inner surface 53 forms an angle 57 with the second longitudinal direction 12. The angle 57 substantially corresponds to the angle 147. The angle 57 may be between 1° and 10°, optionally between 4° and 8°. In this example, the angle 57 is about 7°.

The shape and the dimensions of the guiding protrusion 50 and of the tapered region 160 allows a smooth insertion of the tubular guide (and consequently of the refillable stick case) into the inner member 30 (and consequently into the base). The tubular guide may be precisely guided during insertion and retained into the base when the refillable stick case is coupled to the base. Furthermore, in case of manufacturing the tubular guide and the inner member 30 from a plastic material, these shapes allow an easy extraction from an injector device.

Figure 7:
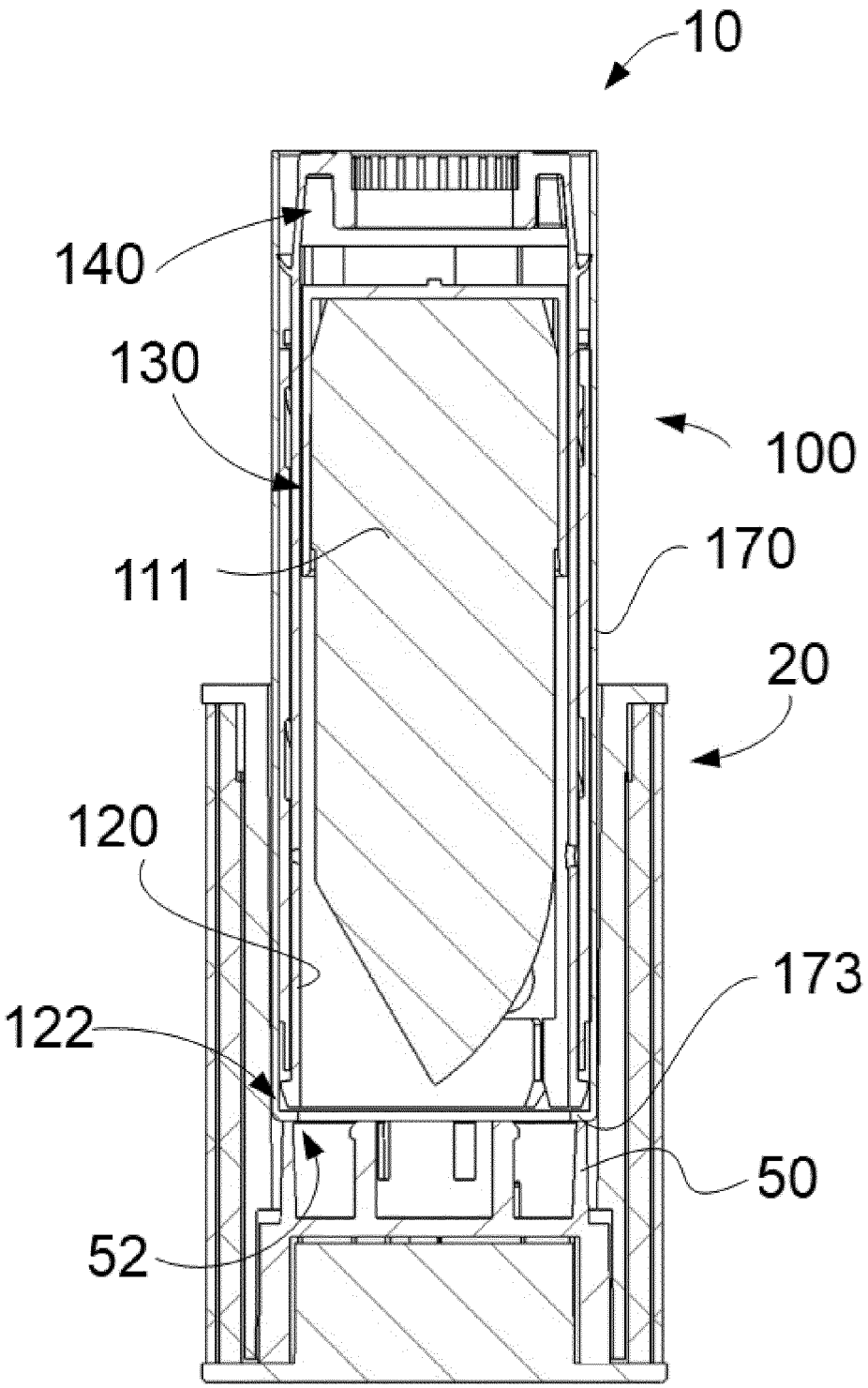
FIG. 7 shows a cross-sectional view of the cosmetic applicator device of FIGS. 2*a* and 2*b* wherein the refillable stick case is intended to be inserted into the base in a reverse orientation.

FIG. 7 shows a cross-sectional view of the cosmetic applicator device of FIGS. 2*a* and 2*b* wherein the refillable stick case is intended to be inserted into the base in a reverse orientation.

In this figure, the refillable stick case 100 is intended to be inserted backwards or in a reverse orientation, i.e. having the tubular guide open end 122 of the tubular guide 120 facing the inner member 30 of the base 20.

The tubular guide comprises a main portion 130 having a main portion outer diameter and a coupling portion 140 having a coupling portion outer diameter. The inner member 30 comprises a guiding protrusion 50 having a guiding protrusion inner diameter. In this figure, the main portion 130 is intended to be inserted into the base. However, a full insertion of the refillable stick case is prevented as the guiding protrusion inner diameter is smaller than the main portion outer diameter.

The guiding protrusion distal end 52 stops the insertion of the refillable stick case 100 into the base. The stick 111 of cosmetic material accommodated inside the refillable stick case is prevented from being contacted by the connector 40 of the inner member 30. The stick 111 of cosmetic material is thus prevented from being damaged.

The tubular shell 170 surrounding the tubular guide 120 comprises a rim 173 arranged at the tubular shell second end. The rim 173 of the tubular shell 170 is stopped by the guiding protrusion distal end 52. The guiding protrusion height is equal or greater than the connector height. The stopping function is further improved. This rim 173 may thus enhance the mistake-proofing configuration of the cosmetic applicator device.

Figure 8:
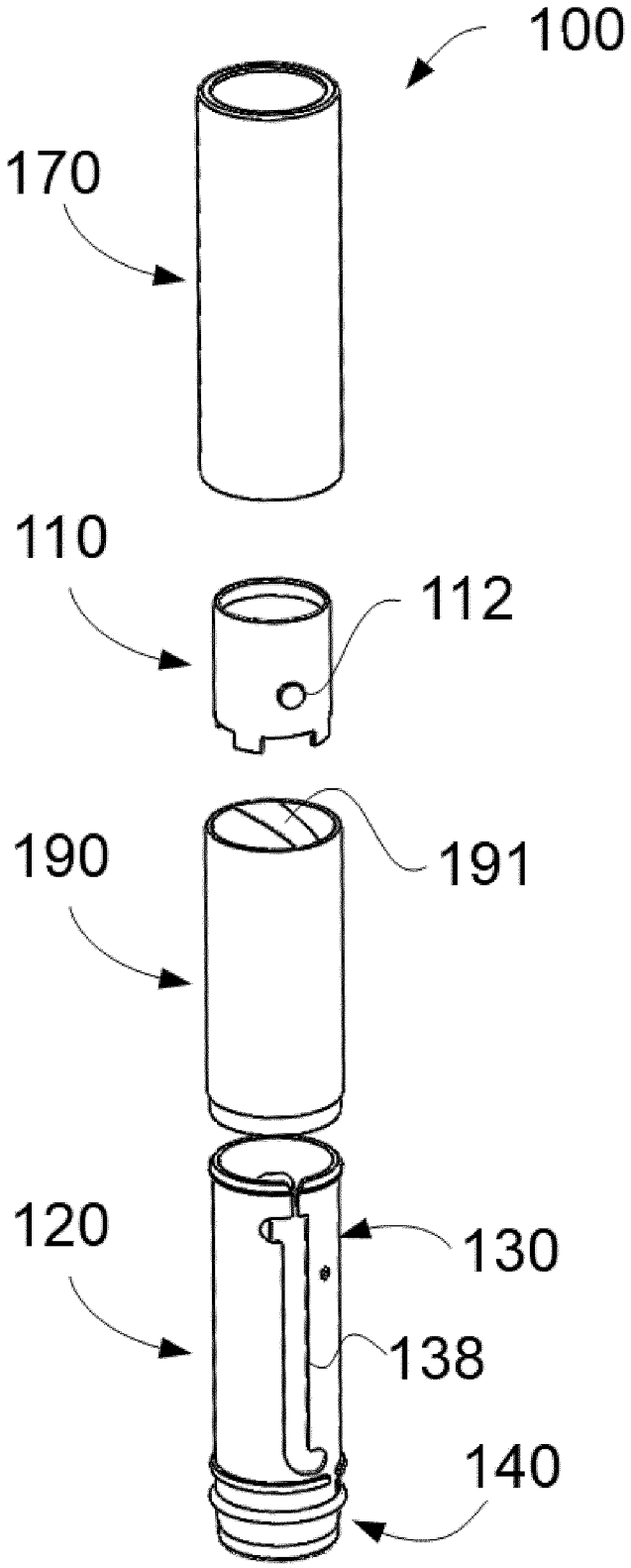
FIG. 8 shows an exploded view of a refillable stick case according to an example of the present disclosure.

FIG. 8 shows an exploded view of a refillable stick case according to an example of the present disclosure. The refillable stick case 100 comprises a tubular guide 120 and a tubular shell 170 according to any of the examples herein disclosed.

A stick holder 110 to hold a stick of cosmetic material (not shown in this figure) may be arranged inside the tubular guide 120. The stick holder 110 may be moved inside the tubular guide 120. The stick holder 110 comprises a pair of stick holder abutments 112. These stick holder abutments 112 may be guided by a pair of longitudinal slots 138 arranged at the main portion 130 of the tubular guide 120. Each of the stick holder abutments 112 engage a different longitudinal slot 138. The stick holder abutments may travel inside the corresponding longitudinal slots 138.

A spiral-like tube 190 may be arranged between the tubular guide 120 and the tubular shell 170. The spiral-like tube 190 comprises a pair of spiral-like grooves 191 extending along its inner surface. The stick holder abutments 112 engage the spiral-like grooves 191.

In this figure, the tubular shell 170 and the spiral-like tube 190 may rotate together. The tubular guide 120 rotates about the tubular shell 170 and the spiral-like tube 190.

The stick holder 110 may be moved in a first longitudinal direction about the tubular guide 120.

The relative rotation of the spiral-like tube 190 about the tubular guide 120 cause a movement of the stick holder 110 relative to the tubular guide 120 in the first longitudinal direction. As the stick holder abutments 112 leaves out through the longitudinal slot 138 and engage the spiral-like grooves 191, a rotation of the spiral-like tube forces an up and down movement of the stick holder 110 relative to the tubular guide 120.

For reasons of completeness, various aspects of the present disclosure are set out in the following numbered clauses:

Clause 1. A cosmetic applicator device comprising:

a refillable stick case;

a base for receiving the refillable stick case;

wherein the refillable stick case is configured to be removably coupled to the base; the refillable stick case extending along a first longitudinal direction and the base extending along a second longitudinal direction, wherein the first longitudinal direction is parallel to the second longitudinal direction when the refillable stick case is coupled to the base;

wherein the refillable stick case comprises:

a stick holder for holding a stick of a cosmetic material;

a tubular guide surrounding the stick holder and extending along the first longitudinal direction between a tubular guide coupling end and a tubular guide open end; wherein the tubular guide comprises:

a main portion having a main portion outer diameter; and a coupling portion longitudinally extending from the main portion to the tubular guide coupling end; the coupling portion comprising a coupling portion outer surface defining a coupling portion outer diameter, wherein the main portion outer diameter is greater than the coupling portion outer diameter at the tubular guide coupling end; and wherein the stick holder is configured to move inside the tubular guide in the first longitudinal direction; and wherein the base comprises an inner member having a transverse wall extending in direction perpendicular to the second longitudinal direction, the inner member comprising:

a guiding protrusion protruding from a protrusion proximal end at the transverse wall to a protrusion distal end in a direction substantially parallel to the second longitudinal direction, wherein the guiding protrusion is configured to guide the coupling portion outer surface of the tubular guide during the insertion of the refillable stick case into the base.

Clause 2. A cosmetic applicator device according to clause 1, wherein the coupling portion of the tubular guide comprises a tapered region so that the coupling portion outer diameter at the tapered region decreases towards the tubular guide coupling end.

Clause 3. A cosmetic applicator device according to clause 2, wherein the coupling portion of the tubular guide comprises a lower straight region, and wherein the tapered region is between the main portion and the lower straight region.

Clause 4. A cosmetic applicator device according to clause 2, wherein the coupling portion outer diameter at the tapered region continuously decreases from the main portion outer diameter to the coupling portion outer diameter at the tubular guide coupling end.

Clause 5. A cosmetic applicator device according to any of clauses 2-4, wherein the coupling portion outer surface at the tapered portion forms an angle between 1° and 10° with the first longitudinal direction, optionally between 4° and 8°.

Clause 6. A cosmetic applicator device according to any of clauses 2-5, wherein the guiding protrusion of the base comprises a wedge-shaped cross-section to substantially engage the tapered region of the coupling portion of the tubular guide.

Clause 7. A cosmetic applicator device according to clause 6, wherein the wedge-shaped cross-section of the guiding protrusion comprises a guiding protrusion inner surface to face the coupling portion outer surface at the tapered portion.

Clause 8. A cosmetic applicator device according to clause 7, wherein the guiding protrusion inner surface forms an angle between 1° and 10° with the second longitudinal direction, optionally between 4° and 8°.

Clause 9. A cosmetic applicator device according to any of clauses 2-8, wherein the tapered region extends a tapered height parallel to the first longitudinal direction between 4 and 8 millimetres, optionally between 5 and 7 millimetres.

Clause 10. A cosmetic applicator device according to any of clauses 1-9, wherein the guiding protrusion is annular or comprises a plurality of annular segments.

Clause 11. A cosmetic applicator device according to clause 10, wherein the guiding protrusion comprises a guiding protrusion inner diameter, wherein the guiding protrusion inner diameter at the protrusion proximal end is greater than the guiding protrusion inner diameter at the protrusion distal end.

Clause 12. A cosmetic applicator device according to any of clauses 1-11, wherein the main portion outer diameter of the tubular guide is 0.5-1.5 millimetres greater than the coupling portion outer diameter at the coupling end, optionally about 0.9 millimetres.

Clause 13. A cosmetic applicator device according to any of clauses 1-12, wherein the coupling portion of the tubular guide comprises a coupling bracket and the inner member comprises a connector configured to be removably coupled to the coupling bracket of the tubular guide.

Clause 14. A cosmetic applicator device according to clause 13, wherein the coupling bracket of the guiding tube comprises:

a coupling tube extending a coupling tube height from the coupling end towards the open end in a direction parallel to the first longitudinal direction, and a wall radially extending from the coupling portion outer surface to the coupling tube.

Clause 15. A cosmetic applicator device according to clause 14, wherein the connector of the guiding protrusion comprises a plurality of snap-fit elements to engage the coupling tube of the coupling bracket of the tubular guide.

Clause 16. A cosmetic applicator device according to any of clauses 14-15, wherein the coupling tube comprises a coupling tube inner surface comprising a plurality of bumps.

Clause 17. A cosmetic applicator device according to any of clauses 13-16, wherein the connector extends a connector height from the transverse wall in a direction parallel to the second direction.

Clause 18. A cosmetic applicator device according to clause 17, wherein the guiding protrusion protrudes a protrusion height from the transverse wall in a direction parallel to the second direction.

Clause 19. A cosmetic applicator device according to clause 18, wherein the protrusion height and the connector height are substantially similar.

Clause 20. A cosmetic applicator device according to any of clauses 1-12, wherein the coupling portion outer surface of the tubular guide comprises a plurality of protrusions configured to engage a plurality of receivers of the guiding protrusion.

Clause 21. A cosmetic applicator device according to any of clauses 1-12, wherein guiding protrusion comprises a guiding protrusion inner surface having a plurality of protrusions configured to engage a plurality of receivers of the coupling portion outer surface.

Clause 22. A cosmetic applicator device according to any of clauses 1-21, wherein the refillable stick case further comprises a tubular shell extending from a tubular shell first end to a tubular shell second end, wherein the tubular shell surrounds the tubular guide.

Clause 23. A cosmetic applicator device according to clause 22, wherein the tubular shell covers the coupling portion of the tubular guide.

Clause 24. A refillable stick case according to any of clauses 22-23, wherein the refillable stick further comprises an annular cavity formed between the tubular shell at the tubular shell first end and the tapered region.

Clause 25. A cosmetic applicator device according to any of clauses 22-24, wherein the guiding protrusion of the base is arranged between the coupling portion of the tubular guide and a portion of the tubular shell of the tubular guide when the refillable stick case is coupled to the base.

Clause 26. A cosmetic applicator device according to clause 25, wherein a gap is defined between a guiding protrusion outer surface and a tubular shell inner surface when the refillable stick case is coupled to the base.

Clause 27. A cosmetic applicator device according to any of clauses 22-26, wherein the tubular shell second end comprises a rim extending inwardly from a tubular shell inner surface in a radial direction, wherein the rim covers at least a portion of the tubular guide open end.

Clause 28. A cosmetic applicator device according to clause 27, wherein the guiding protrusion is configured to contact the rim of the tubular shell during the insertion of the refillable stick into the base when the tubular guide open end faces the base.

Clause 29. A cosmetic applicator device according to any of clauses 22-28, wherein the tubular guide comprises an annular lip extending outwardly from a tubular guide outer surface.

Clause 30. A cosmetic applicator device according to clause 29, wherein the annular lip extends from a transition region between the main portion outer surface and the coupling portion outer surface.

Clause 31. A cosmetic applicator device according to clause 30, wherein a distal end of the annular lip contacts a tubular shell inner surface.

Clause 32. A cosmetic applicator device according to any of clauses 1-31, wherein the base comprises a support element having a cylindrical body and a flange extending outwardly from the cylindrical body in a radial direction, wherein the inner member engages the inner member.

Clause 33. A cosmetic applicator device according to any of clauses 1-32, wherein the cosmetic applicator device is configured in such a way that a rotation of the inner member, when the tubular guide is coupled to the inner member, causes a movement of the stick holder in the first longitudinal direction.

Clause 34. A cosmetic applicator device according to any of clauses 1-33, wherein the stick holder holds a stick of a cosmetic material, the stick of a cosmetic material being a lipstick.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow.

What is claimed is:

1. A cosmetic applicator device comprising:

a refillable stick case;

a base for receiving the refillable stick case;

wherein the refillable stick case is configured to be removably coupled to the base; the refillable stick case extending along a first longitudinal direction and the base extending along a second longitudinal direction, wherein the first longitudinal direction is parallel to the second longitudinal direction when the refillable stick case is coupled to the base;

wherein the refillable stick case comprises:

a stick holder for holding a stick of a cosmetic material;

a tubular guide surrounding the stick holder and extending along the first longitudinal direction between a tubular guide coupling end and a tubular guide open end; wherein the tubular guide comprises:

a main portion having a main portion outer diameter; and a coupling portion longitudinally extending from the main portion to the tubular guide coupling end; the coupling portion comprising a coupling portion outer surface defining a coupling portion outer diameter, wherein the main portion outer diameter is greater than the coupling portion outer diameter at the tubular guide coupling end;

wherein the coupling portion of the tubular guide comprises a tapered region so that the coupling portion outer diameter at the tapered region decreases towards the tubular guide coupling end; and wherein the stick holder is configured to move inside the tubular guide in the first longitudinal direction; and wherein the base comprises an inner member having a transverse wall extending in a direction perpendicular to the second longitudinal direction, the inner member comprising:

a guiding protrusion protruding from a protrusion proximal end at the transverse wall to a protrusion distal end in a direction substantially parallel to the second longitudinal direction, wherein the guiding protrusion is configured to guide the coupling portion outer surface of the tubular guide during an insertion of the refillable stick case into the base, and wherein the guiding protrusion comprises a shape complementary to the coupling portion of the tubular guide.

2. The cosmetic applicator device according to claim 1, wherein the coupling portion outer surface at the tapered region forms an angle between 1° and 10° with the first longitudinal direction.

3. The cosmetic applicator device according to claim 1, wherein the guiding protrusion of the base comprises a wedge-shaped cross-section to engage the tapered region of the coupling portion of the tubular guide.

4. The cosmetic applicator device according to claim 1, wherein the guiding protrusion is annular.

5. The cosmetic applicator device according to claim 1, wherein the guiding protrusion comprises a plurality of annular segments.

6. The cosmetic applicator device according to claim 1, wherein the guiding protrusion comprises a guiding protrusion inner diameter, wherein the guiding protrusion inner diameter at the protrusion proximal end is greater than the guiding protrusion inner diameter at the protrusion distal end.

7. The cosmetic applicator device according to claim 1, wherein the refillable stick case further comprises a tubular shell extending from a tubular shell first end to a tubular shell second end, wherein the tubular shell surrounds the tubular guide.

8. The cosmetic applicator device according to claim 7, wherein the guiding protrusion of the base is arranged between the coupling portion of the tubular guide and a portion of the tubular shell of the tubular guide when the refillable stick case is coupled to the base.

9. The cosmetic applicator device according to claim 7, wherein the tubular shell second end comprises a rim extending inwardly from a tubular shell inner surface in a radial direction, wherein the rim covers at least a portion of the tubular guide open end.

10. The cosmetic applicator device according to claim 9, wherein the guiding protrusion is configured to contact the rim of the tubular shell during the insertion of the refillable stick into the base when the tubular guide open end faces the base.

11. The cosmetic applicator device according to claim 1, wherein the cosmetic applicator device is configured in such a way that a rotation of the inner member, when the tubular guide is coupled to the inner member, causes a movement of the stick holder in the first longitudinal direction.

12. A refillable stick case for a cosmetic applicator device, wherein the refillable stick case is configured to be removably coupled to a base of the cosmetic applicator device; the refillable stick case extending along a first longitudinal direction, wherein the refillable stick case comprises:

a stick holder for holding a stick of a cosmetic material;

a tubular guide surrounding the stick holder and extending along the first longitudinal direction between a tubular guide coupling end and a tubular guide open end; wherein the tubular guide comprises:

a main portion having a main portion outer diameter; and a coupling portion longitudinally extending from the main portion to the tubular guide coupling end; the coupling portion comprising:

a tapered region comprising a coupling portion outer surface defining a coupling portion outer diameter, wherein the coupling portion outer diameter decreases towards the tubular guide coupling end so that the main portion outer diameter is greater than the coupling portion outer diameter at the tubular guide coupling end, wherein the stick holder is configured to move inside the tubular guide in the first longitudinal direction; and wherein the refillable stick comprises a tubular shell surrounding the tubular guide and extending from a tubular shell first end to a tubular shell second end, wherein the refillable stick further comprises an annular cavity formed between the tubular shell at the tubular shell first end and the tapered region.

13. The refillable stick case according to claim 12, wherein the coupling portion outer surface forms an angle between 1° and 10° with the first longitudinal direction.

14. The refillable stick case according to claim 12, wherein the main portion outer diameter of the tubular guide is 0.5-1.5 millimetres greater than the coupling portion outer diameter at the tubular guide coupling end.

15. The refillable stick case according to claim 12, wherein the tubular shell covers the coupling portion of the tubular guide.

16. The refillable stick case according to claim 12, wherein the tubular guide comprises an annular lip extending outwardly from a tubular guide outer surface.

17. The refillable stick case according to claim 16, wherein the annular lip extends from a transition region between the main portion outer surface and the coupling portion outer surface.

18. The refillable stick case according to claim 12, wherein the coupling portion outer surface of the tubular guide comprises a plurality of protrusions configured to engage a plurality of receivers of a guiding protrusion of the base of cosmetic applicator device.

19. The refillable stick case according to claim 12, wherein the coupling portion outer diameter at the tapered region continuously decreases from the main portion outer diameter to the coupling portion outer diameter at the tubular guide coupling end.

* * * * *